United States Patent [19]

Furuzono et al.

[11] Patent Number: 4,485,132

[45] Date of Patent: Nov. 27, 1984

[54] METHOD OF CONTINUOUS COATING OF METALLIC STRIP MATERIAL

[75] Inventors: Yoshihisa Furuzono; Toshiyuki Kajiwara; Toshiyuki Kadota, all of Hitachi; Kazuyuki Nakano, Ichikawa; Kenzi Tabusi, Chiba, all of Japan

[73] Assignees: Hitachi, Ltd.; Nisshin Steel Co., Ltd., both of Tokyo, Japan

[21] Appl. No.: 398,865

[22] Filed: Jul. 16, 1982

[30] Foreign Application Priority Data

Jul. 17, 1981 [JP] Japan ..... 56-110733

[51] Int. Cl.[3] ..... B05D 1/28

[52] U.S. Cl. ..... 427/428; 118/688; 118/249; 118/259; 118/261; 118/262

[58] Field of Search ..... 427/428; 118/688, 249, 118/259, 261, 262

[56] References Cited

U.S. PATENT DOCUMENTS

| | | | |
|---|---|---|---|
| 2,624,914 | 1/1953 | Rhodes | 118/259 X |
| 2,641,220 | 6/1953 | Weber et al. | 118/259 |
| 3,239,367 | 3/1966 | Demeter | 118/262 |
| 3,659,553 | 5/1972 | Tobias | 118/261 |
| 3,759,220 | 9/1973 | Saito et al. | 118/261 |
| 4,251,566 | 2/1981 | Gingerich | 118/688 |
| 4,329,923 | 5/1982 | Iida | 101/365 |

*Primary Examiner*—Shrive P. Beck

*Attorney, Agent, or Firm*—Antonelli, Terry & Wands

[57] ABSTRACT

A method of continuous coating of metallic strip material carried into practice by using a continuous strip coating device wherein the thickness of the coating is decided by a gap between a pickup roll and a thickness control member spaced apart a predetermined distance from the surface of the pickup roll. The method includes the step of (1) setting the pressure of the paint and/or the size of the gap based on the data obtained by preliminary experiments, or (2) directly measuring the gap between the surface of the pickup roll and the thickness control member and feeding back the measurement, to bring the actual size of the gap into agreement with the value set beforehand at all times.

3 Claims, 9 Drawing Figures

METHOD OF CONTINUOUS COATING OF METALLIC STRIP MATERIAL

FIELD OF THE INVENTION

This invention relates to methods of continuous coating of metallic strip material, and more particularly it is concerned with a method of continuous coating of strip material of metal wherein a coating of a desired thickness is formed on the surface of the metallic strip material by applying thereto through an applicator roll a paint fed to a pickup roll.

DESCRIPTION OF THE PRIOR ART

Figure 1:
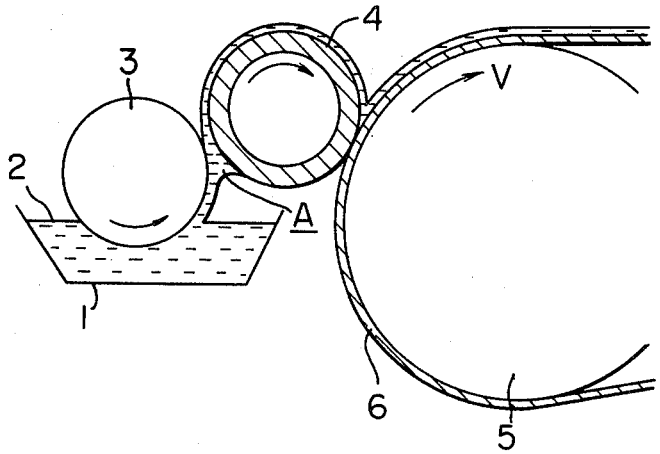
FIG. 1 PRIOR ART
FIG. 1 is a schematic view of a continuous metallic strip material coating device of the prior art.

FIG. 1 shows a coating device of the prior art generally used for carrying out continuous coating of metallic strip material. As shown, a paint 2 in a paint pan 1 is transferred to the surface of a pickup roll 3 immersed in the paint 2 while rotating, and transferred further from the surface of the pickup roll 3 to the surface of an applicator roll 4. Then the paint is applied to the surface of metallic strip material (hereinafter strip) 6, such as aluminum strip or zinc plated steel strip, which is moved by a backup roll 5 and travelling relative to the applicator roll 4, to thereby form a coating continuously on the surface of the strip 6. In this type of device, there are two systems of operation: in one system, the rolls 3, 4 and 5 are rotated in the directions of respective arrows (reverse system), and in the other system, the applicator roll and the pickup roll are rotated in directions opposite the directions indicated by the arrows in FIG. 1 (natural system). Which of the two systems is adopted may be decided depending on the type of the paint used and the purpose for which the product is used.

In order to obtain a predetermined thickness of the coating applied to the surface of the strip 6, the paint 2 fed to the pickup roll 3 is regulated by a measuring section (thickness regulating section) A between the pickup roll 3 and the applicator roll 4, so that when the paint 2 is excessive in amount, it is scraped off by being pressed between the two rolls 3 and 4 and the paint 2 of a predetermined thickness is fed to the strip 6.

In order to avoid damaging the surface of the strip 6, the applicator roll 4 usually has provided on its surface a layer of resilient material, such as rubber, which tends to have its thickness or hardness influenced by the solvent contained in the paint which is brought into contact therewith during use. Thus the gap between the two rolls would vary in size and the regulating force exerted on the paint 2 to keep its thickness constant would undergo changes, with a result that difficulties would be faced with in obtaining a predetermined thickness in a coating applied by the applicator roll 4 to the strip 6. Also, wear would be caused on the surface of the resilient material layer as the roll is repeatedly used, and the position of the applicator roll 4 would be adjusted accordingly. However, when the resilient material layer on the surface of the applicator roll 4 has a large thickness, the pressure applied by the paint 2 causes a great change to occur in the resilient material layer. Thus if the thickness of the resilient material layer is small when the coating to be formed has a large thickness, then the change in the resilient layer would be reduced and the coating would have its thickness reduced.

Figure 2:
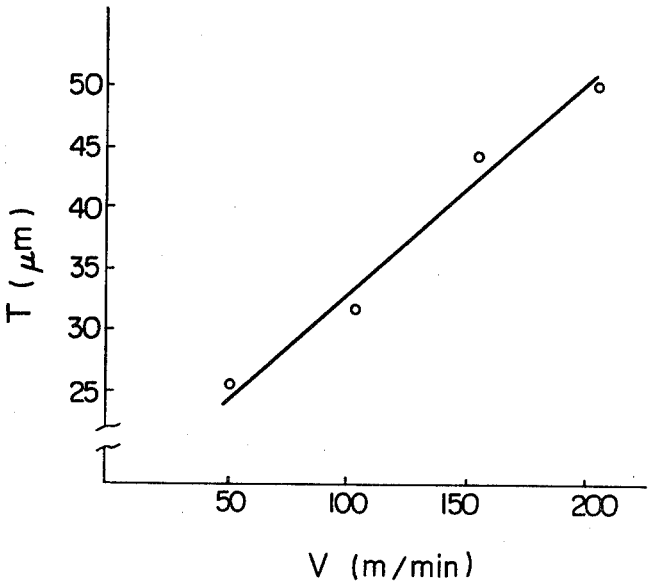
FIG. 2 PRIOR ART
FIG. 2 is a diagrammatic representation of the performance characteristic of the device of the prior art shown in FIG. 1.

The thickness of the coating may vary depending on the line velocity V of the strip 6. In the diagram shown in FIG. 2, the abscissa is represented by the line velocity V (m/min) and the ordinate indicates the coating thickness T ($\mu$m) on the strip 6, the coating thickness T being measured when the coating is in a wet state. In the graph of FIG. 2 showing the relation between the line velocity and the coating thickness obtained in the device shown in FIG. 1, the ratio of the peripheral velocity of one roll to that of the other roll is kept constant.

As can be seen clearly in FIG. 2, a rise in line velocity V results in an increase in coating thickness T. This is believed to be attributed to an increase in the amount of paint 2 drawn from the paint pan 1 by the pickup roll 3 as the velocity of the paint on the surface of the pickup roll increases with a rise in line velocity, with a result that the force of the paint exerted on the deformable resilient material layer at the measuring section A increases when the line velocity V becomes higher and the deformation of the resilient material layer exceeds the preset level of deformation.

As described hereinabove, it has hitherto been very difficult to effect thickness control of the coating applied to the surface of the strip 6 by the method of the prior art carried into practice by the device shown in FIG. 1. In the prior art, the coating has its thickness set beforehand by varying the force which is exerted on the paint on the pickup roll at the measuring section A, but the thickness of the coating obtained may sometimes show a variation because of changes in various conditions during operation. Thus highly advanced skills are required in effecting thickness control by taking various conditions into consideration.

To obviate the aforesaid problem of the prior art, proposals have in recent years been made to effect thickness control of the coating continuously applied to the surface of strip by means of a feedback of values of the coating thickness measured on the exit side of the baking furnace.

Some disadvantages are associated with this system of thickness control. The value of the thickness of the coating as measured may vary depending on the type and color of the paint used, and sometimes become impossible to measure. In actual practice, the thickness measuring instrument and the coating device are usually spaced apart a distance of about 100 meters. This means that a portion of the strip that travels this distance before correction is made by the feedback would be a total loss.

SUMMARY OF THE INVENTION

This invention has been developed for the purpose of obviating the aforesaid problems of the prior art. Accordingly the invention has as its object the provision of a method of continuous coating of metallic strip material capable of setting the thickness of a coating to be applied and effecting thickness control on the side of the painting with ease.

To accomplish the aforesaid object, there is provided, in a method of continuous coating of metallic strip material wherein the amount of a paint fed to a pickup roll is regulated to a predetermined film thickness by a thickness control member facing the surface of the roll when the paint is transferred to an applicator roll, the paint being successively transferred from the applicator roll to the surface of the metallic strip material continuously travelling relative to the applicator roll to form a coating of a desired thickness on the surface of the metallic strip material, the feature that the relation between the thickness of the applied coating and the pressure of the paint fed to the pickup roll and/or the relation between the thickness of the applied coating and the size of a gap as viewed radially of the pickup roll between the roll surface and the thickness regulating member are set beforehand and the pressure of the paint and/or the size of the gap are controlled based on the aforesaid relations, to thereby obtain the desired thickness in a coating formed on the metallic strip material.

In the invention, any variation in the thickness of the coating applied to the surface of the metallic strip material that might occur during one strip coating step can be avoided by directly measuring the gap between a rotating roll and a stationary member and feeding back the measurements to thereby keep the gap between the rotating roll and the stationary member at the same value as set beforehand.

The above and further objects and novel features of the invention will more fully appear from the following detailed description when the same is read in connection with the drawings. It is to be expressly understood, however, that the drawings are intended for purpose of illustration only and are not intended as a definition of the limits of the invention.

DETAILED DESCRIPTION OF THE PREFERRED EMBODIMENTS

Preferred embodiments of the invention will now be described by referring to the accompanying drawings.

Figure 3:
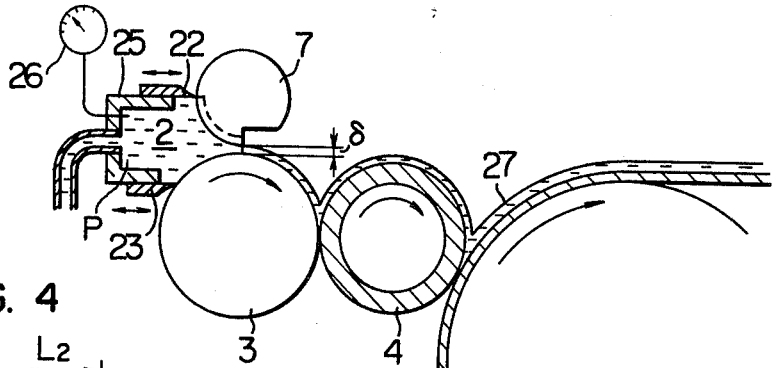
FIG. 3 is a schematic view of a continuous metallic strip material coating device suitable for carrying into practice a first embodiment of the invention.
Figure 4:
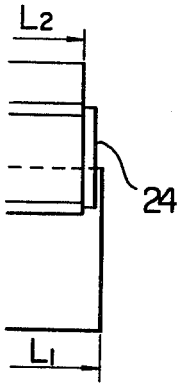
FIG. 4 is a view in explanation of the essential portions of the device shown in FIG. 2, as shown in a plane.

FIG. 3 shows one example of the coating device suitable for use in carrying one embodiment of the method in conformity with the invention into practice. The device is essentially a roll coating device for continuously coating a strip 16 with a paint 2 by using a pickup roll 3, an applicator roll 4 and a backup roll 5. The paint 2 is contained in a paint dam 25 made up of an upper seal plate 22, a lower seal plate 23 and side seal plates 24 for smoothly feeding the paint 2 under pressure. The paint dam 25 is equipped with a manometer 26. The pickup roll 3 which is formed of steel has mounted above the surface of the roll 3 a doctor blade 7 which is also formed of steel for regulating the amount of the paint 2 fed to the pickup roll 3. The doctor blade 7 and the surface of the pickup roll 3 define therebetween a radial gap $\delta$ which can be adjusted. As shown in FIG. 4, the pickup roll 3 and the doctor blade 7 have widthwise dimensions $L_1$ and $L_2$ respectively which are substantially equal to each other. To measure the gap $\delta$, the doctor blade 7 has gap sensors, not shown, mounted at opposite ends thereof.

By using the device shown in FIG. 3, a coating 27 was formed on the surface of the strip 6, and the influences exerted on the thickness T of the coating 27 by the pressure P applied to the paint 2 in the paint dam 25 and the gap $\delta$ between the pickup roll 3 and the doctor blade 7 were investigated by varying the pressure P and the gap $\delta$ in different fashions. The results of the experiments conducted in this way are shown in FIGS. 5 and 6.

Figure 5:
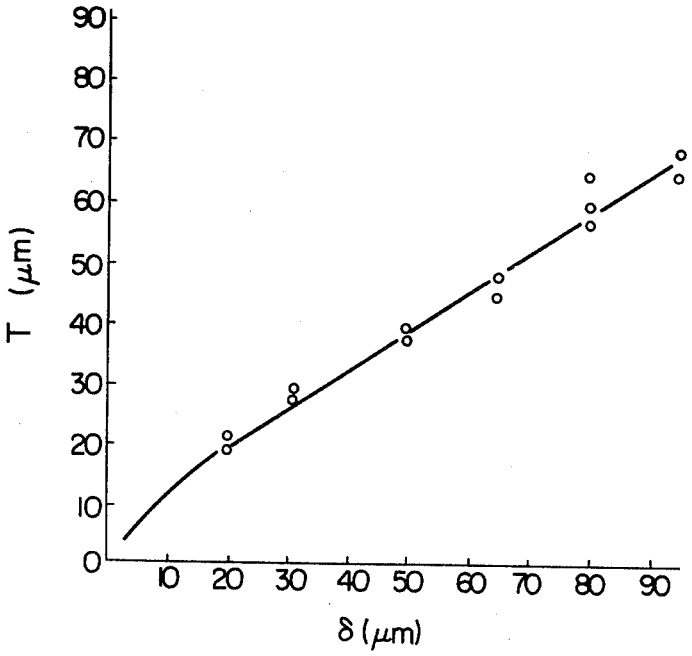
FIG. 5 is a diagrammatic representation of the relation between the thickness of the applied coating and thickness regulating gap in the first embodiment of the invention.

FIG. 5 shows a diagram in which the abscissa is represented by the gap $\delta$ ($\mu$m) between the pickup roll 3 and the doctor blade 7 and the ordinate indicates the thickness T ($\mu$m) of the coating 27 to show the relation T-$\delta$. The single curve represents a paint pressure P of 0.3 kg/cm$^2$. As can be seen in the graph in FIG. 5, the thickness T of the coating 27 is relatively susceptible to influences exerted by the gap $\delta$ and changes in thickness T are not linear.

Figure 6:
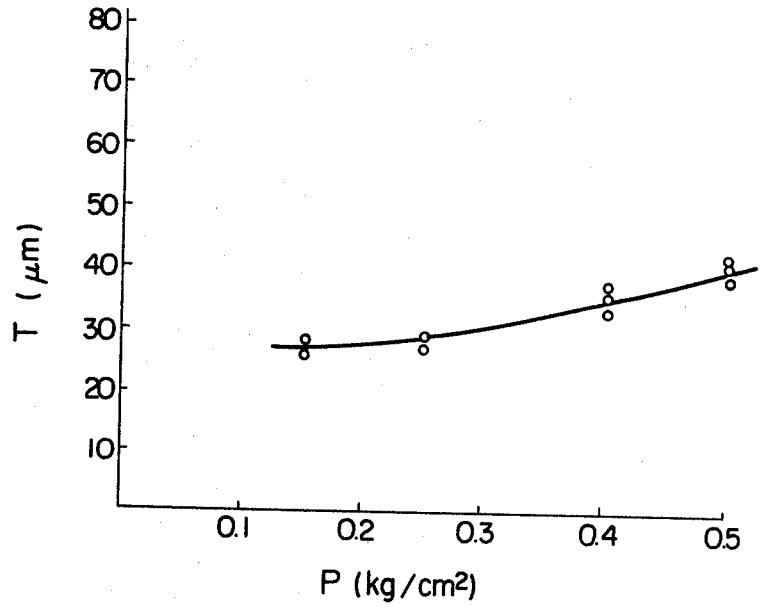
FIG. 6 is a diagrammatic representation of the relation between the thickness of the applied coating and the paint feeding pressure in the first embodiment of the invention.

FIG. 6 shows a graph in which the abscissa is represented by the pressure P (kg/cm$^2$) of the paint 2 in the paint dam 25 and the ordinate is indicated by the thickness T of the coating 27 for showing the relation T-P. In the diagram, the single curve indicates the gap $\delta$ as having a value 30 $\mu$m. As can be clearly seen in the graph in FIG. 6, the thickness T of the coating 27 is not influenced greatly by changes in the pressure P of the paint 2.

Figure 7:
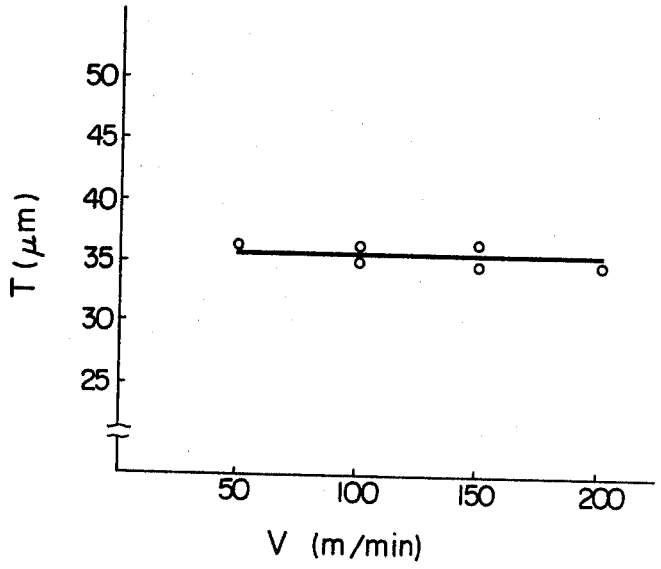
FIG. 7 is a diagrammatic representation of the relation between the thickness of the applied coating and the line velocity in the first embodiment of the invention.

In the experiments described hereinabove, the relation between the thickness T ($\mu$m) of the coating 27 and the line velocity V (m/sec) was also measured and the results are shown in FIG. 7. The exeriments were conducted by keeping the pressure P of the paint 2 constant while maintaining the ratios of the peripheral velocities of the rolls equal to one another. As can be clearly seen in the graph in FIG. 7, the thickness T (ordinate) of the coating 27 showed almost no change with respect to changes in the line velocity V (abscissa). This is attributed to the fact that the pickup roll 3 and the doctor blade 7 for regulating the thickness of the coating 27 are both formed of steel of high rigidity and the rigidity of these members exerts an arresting influence on the amount of the paint which tends to increases as the paint tends to increase in amount which is drawn from the roll as the line velocity increases.

As described hereinabove, in the embodiment of the invention, it has been ascertained that the gap $\delta$ between the pickup roll and the doctor blade and the supply pressure P of the paint are the factors that are concerned in determination of the thickness T of the coating applied to the surface of the metallic strip material, and the relations T-$\alpha$ and T-P have been found as the results of the experiments to be substantially linear. Thus when application of a coating on the surface of the strip 6 is carried out continuously by the method according to the invention by using the device shown in FIG. 3, the gap $\delta$ and the pressure P are set before the operation in a manner to enable the desired thickness to be obtained in a coating based on the experimental data.

Thus, in the embodiment of the invention, the gap δ of the thickness regulating section and the paint supply pressure P in relation to the thickness T of the coating applied to the strip 6 are decided experimentarily beforehand, and the coating device is set, when a coating operation is performed, with the values of δ and/or T based on the aforesaid relations to obtain the desired thickness T in a coating. Thus the invention enables thickness control to be readily effected with success in continuously coating metallic strip material. As compared with measuring of the thickness of the coating, measuring of the gap δ and the pressure P can be readily carried out with increased accuracy, so that thickness control can be effected by the method according to the invention with a high degree of reliability.

In the embodiment described hereinabove, the gap δ and the pressure P have been described as being used as the factors deciding the thickness of a coating to be applied continuously to metallic strip material. It is to be understood, however, the thickness of a coating can be controlled by using only one of the two factors, such as the gap δ.

According to the method of the invention, the thickness of a coating applied to the surface of metallic strip material continuously can be readily and positively controlled as desired without any trouble.

By using the method of the embodiment of the invention shown and described hereinabove, it is possible to obtain a coating of predetermined thickness when continuous coating of metallic strip material is carried out by obviating the disadvantages of the prior art. In the first embodiment, the gap δ and the pressure P are set before coating operations are performed. Thus these values are kept constant during coating of one strip. Stated differently, no means is provided for coping with factors that might possibly cause changes to occur in the thickness of the coating during continuous coating of the strip. There has, in recent years, been a tendency to a reduced thickness of the coating applied to metallic strip material to conserve paint and reduce the weight of the final product. A reduction in the thickness of the coating would cause serious defects to occur. The factors concerned in possible changes in the thickness include the precision with which rotating rolls are machined in performing cylindical and circular works, the precision with which the bearings of the rolls are assembled and thermal deformation of the parts of the device that might occur due to variations in ambient temperature, for example. From the point of view of reducing cost, it is inadvisable to try to eliminate these factors or potential sources of trouble beforehand or to carry out machining with superhigh precision finishes or to control ambient temperature by using sophisticated equipment. To cope with this situtation, the invention provides, in a second embodiment presently to be described, a solution to the aforesaid problem of how to control the thickness of a coating to maintain uniformity of thickness in applying a coating of small thickness to metallic strip material.

Figure 8:
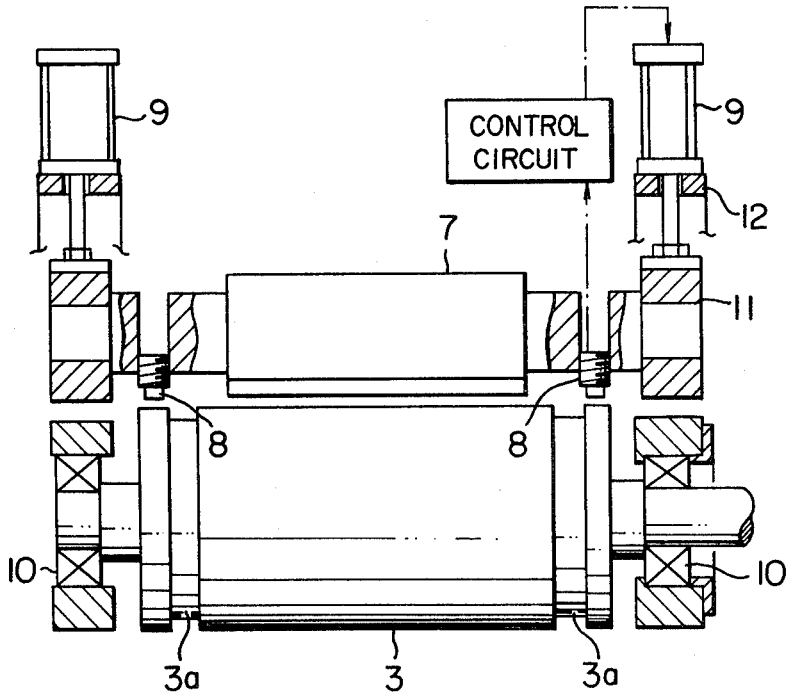
FIG. 8 is a side view, with certain parts being cut out, of a continuous metallic strip material coating device suitable for carrying into practice a second embodiment of the invention.

FIG. 8 shows a coating device suitable for carrying the second embodiment of the invention into practice, wherein the doctor blade 7 has embedded in opposite end portions thereof gap sensors 8 for directly sensing or measuring the size of the gap between the doctor blade 7 and the pickup roll 3 for determining the thickness of the coating applied to the strip. To avoid contamination of the sensors 8 by the paint, the pickup roll 3 is formed in the vicinity of its opposite end portions with paint drain grooves 3*a*, and, although not clearly shown, chocks 11 at opposite ends of the doctor blade 7 are each provided with a stand 12. The chocks 11 are each connected to a hydraulic servo-cylinder 9.

Figure 9:
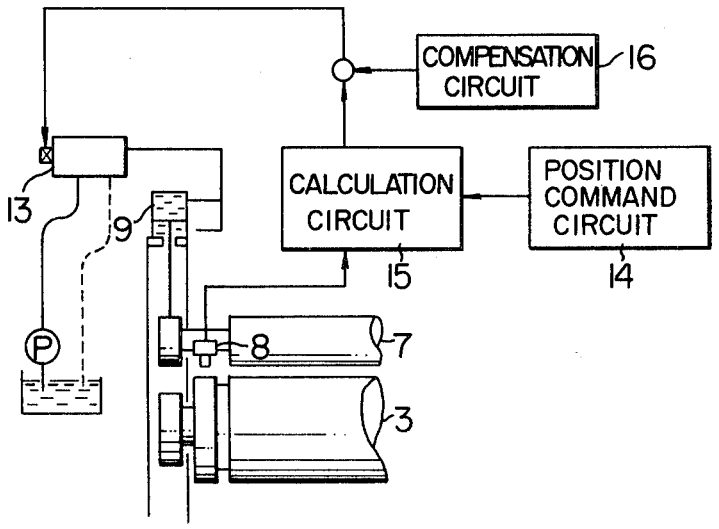
FIG. 9 is a view showing a modification of the device shown in FIG. 8.

Adjustments of the gap between the pickup roll 3 and the doctor blade 7 are effected by actuating the hydraulic servo-cylinders 9 to render the doctor blade 7 operative. The working range of the hydraulic servo-cylinders 9 are decided by means of a circuit shown in FIG. 9. A target value (set value) of the gap is input to a position command circuit 14 and compared at a calculation circuit 15 with the value of the gap sensed by the sensors 8. In the event that there is a differential between them, a correction command is given by a compensation circuit 16 to a servo-valve 13 which actuates the servo-cylinders 9, to thereby shift the doctor blade 7 until the actual value of the gap is brought into agreement with the set value thereof. The correction mechanism according to the invention is of the aforesaid construction.

In the method according to the invention for continuous coating of a metallic strip material, position control is effected by comparing the actual size of the gap between the surface of the pickup roll 3 and the doctor blade 7 with the set value at all times. Thus it is possible to detect changes caused by eccentricity of the roll or by variations in temperature and to effect control in a manner to bring the gap between the pickup roll 3 (rotating roll) and the stationary doctor blade 7 into agreement with the gap of the set value.

In the embodiment shown and described hereinabove, a hydraulic servo-cylinder is used in the correction mechanism. It is to be understood, however, that the invention is not limited to this specific form of the actuator and that an electric motor or other suitable known means may be used for effecting position control. Also, in the embodiment shown and described hereinabove, the doctor blade 7 is used as a stationary member for deciding the thickness of a coating, but the use of a stationary metallic roll in place of the doctor blade 7 can, of course, achieve the same effect. The sensors 8 may be mounted in the chocks 11 for the doctor blade 7 or other positions thereof for sensing changes in the gap between the surface of the pickup roll 3 and the doctor blade 7. Although control is carried out at all times in the embodiment of the invention, it is possible that sampling control is effected by utilizing the fact that changes occur with some regularity.

In the method comprising the second embodiment of the invention, the gap between the rotating roll member and the stationary thickness control member is directly measured and the measurements are fed back to effect correction in a manner to bring the actual value of the gap between the thickness control member and the rotating roll into agreement with the value set beforehand. Thus it is possible to avoid variations in the thickness of the coating to occur in a single strip, and when a thin coating is applied, there is no risk of color variations occurring in the strip. In addition, waste of a paint due to superposing of the paint on the coating already formed and changes in the thickness of the coating can be avoided.

While preferred embodiments of the invention have been described using specific terms, such description is for illustrative purposes only, and it is to be understood that changes and variations may be made without departing from the spirit or scope of the following claims.

What is claimed is:

1. A method of continuous coating of metallic strip material comprising the steps of regulating the amount of a paint fed to a pickup roll to a predetermined film thickness by a thickness control member facing the surface of the pickup roll when the paint is transferred to an applicator roll, and successively transferring the paint from the applicator roll to the surface of the metallic strip material continuously travelling relative to the applicator roll to form a coating of a desired film thickness on the surface of the metallic strip material, the regulating of the amount of paint fed to the pickup roll being effected by the steps comprising:

setting beforehand a first relation representing the relation between a thickness of the coating applied under constant pressure of the paint fed to the pickup roll and the size of a gap as viewed radially of the pickup roll between the roll surface and the thickness control member;

selecting a size of the gap corresponding to said predetermined film thickness on the basis of said relation; and regulating the size of the gap at the selected value in a feedback control manner, said regulating step for the gap size including a direct measuring of an actual size of said gap at the opposite end portions of said pickup roll, said opposite end portions being separated from a mid portion of the pickup roll by paint drain grooves for protecting said opposite end portions from paint contamination.

2. A method as claimed in claim 1, wherein the paint is fed under pressure to the pickup roll from a hermetically sealed paint container, and said pickup roll and said thickness control member are both formed of rigid material.

3. A method as claimed in claim 2, wherein said thickness control member comprises a stationary doctor blade formed of metal and said pickup roll has a roll surface formed of metal.

* * * * *